US005281298A

United States Patent [19]

Poisson et al.

[11] Patent Number: 5,281,298

[45] Date of Patent: Jan. 25, 1994

[54] FILM TRANSFER DEVICE

[75] Inventors: Norman D. Poisson, Andover; William E. Tucker, Attleboro, both of Mass.

[73] Assignee: The Gillette Company, Boston, Mass.

[21] Appl. No.: 845,227

[22] Filed: Mar. 3, 1992

[51] Int. Cl.[5] ..... B32B 31/00

[52] U.S. Cl. ..... 156/579; 156/523; 156/577

[58] Field of Search ..... 156/523, 526, 527, 577, 156/579, 574

[56] References Cited

U.S. PATENT DOCUMENTS

| | | | |
|---|---|---|---|
| Re. 32,010 | 10/1985 | Collins | 156/527 |
| D. 207,468 | 4/1967 | Addis | D74/1 |
| D. 214,405 | 6/1969 | Fleming | D19/2 |
| D. 238,360 | 1/1976 | Gibbs | D19/2 |
| D. 298,339 | 11/1988 | Eisenberg et al. | D19/67 |
| D. 310,846 | 9/1990 | Sakurai | D19/69 |
| 2,546,308 | 3/1951 | Kahler | 156/577 X |
| 3,342,662 | 9/1967 | Grasmann | 156/523 X |
| 3,839,127 | 10/1974 | Hazuka et al. | 156/540 |
| 3,850,779 | 11/1974 | Pearson | 156/523 |
| 3,902,956 | 9/1975 | Thompson, Jr. | 156/523 |
| 4,336,097 | 6/1982 | Van Kampen et al. | 156/527 |
| 4,574,030 | 3/1986 | Pilcher | 156/579 X |
| 4,591,407 | 5/1986 | Samuelson | 156/527 |
| 4,704,185 | 11/1987 | Fischer | 156/577 |
| 4,849,064 | 7/1989 | Manusch et al. | 156/579 X |
| 4,851,076 | 7/1989 | Manusch et al. | 156/577 |
| 4,853,074 | 8/1989 | Manusch et al. | 156/577 |
| 5,006,184 | 4/1991 | Manusch et al. | 156/577 |

*Primary Examiner*—David A. Simmons
*Assistant Examiner*—James J. Engel, Jr.
*Attorney, Agent, or Firm*—Owen J. Meegan; Aubrey C. Brine; Donal B. Tobin

[57] ABSTRACT

A hand operated device for transferring a film from a carrier tape to a substrate is provided with a planar surface on its bottom wall, having a pair of laterally disposed flanges extending outwardly from the side walls, the side walls forming a hand gripping surface. An applicator bar over which a carrier tape is fed is spring biased downwardly to a point below the bottom planar surface, the point being such that the force required to raise the applicator bar to the plane of the planar surface is equal to the force required for laydown of the film onto the substrate. The device is operated by movement of the device over the substrate with said planar surface in contact with the substrate.

14 Claims, 1 Drawing Sheet

FILM TRANSFER DEVICE

BACKGROUND OF THE INVENTION

The present invention relates to a device for applying a correction film to a substrate surface and more particularly to a hand operated device for transferring a film from a carrier tape to a substrate such as paper.

The prior art has provided devices which are designed to apply an adhesive film to a surface, the film generally provided on a carrier tape and being of the type which adheres to the substrate surface when pressure is applied against the tape at the surface. Typical of such devices are those disclosed and described in U.S. Pat. Nos. 4,849,064, 4,851,076, and 4,853,074 each issued in the name of Manusch et al.

In general these devices under consideration are formed of a housing having a feed reel containing the carrier tape disposed within the housing and a reel for accepting the tape after usage, the tape being fed over an applicator member which extends from the housing and is generally disposed on a spring support of some type. The device is held in the hand of the user who applies the applicator to the substrate and exerts that pressure which he deems sufficient to press the tape against the substrate for transfer of the film to the substrate while maintaining the tape at a substantially uniform pressure across the tape width, such that the film is evenly applied.

While these devices have proved to be adequate, the requirement of the user to both provide adequate pressure to the applicator to be subsequently transferred to the tape, and the necessity to stabilize the applicator to provide uniform pressure across the width of the tape, by manipulation of the device, leaves room for improvement. Should the pressure applied by the user be insufficient to cause transfer of the film to the substrate, skipping will occur leaving portions of the substrate area being worked upon uncovered by the film. Likewise, should the applicator over which the tape is fed be subjected to variable pressure from side to side movement of the device, various portions of the film will not adhere to the substrate leaving a skipping motion across the width of the tape. These conditions often prove undesirable and it is often necessary that the user of a device of the type under consideration practice with the device in order to obtain satisfactory results each time the device is used.

It is therefore an object of the present invention to provide a hand operated device for transferring film from a carrier tape to a substrate in which the pressure determined to apply the film from the tape onto the substrate is automatically achieved by the user with each application.

A further object of the invention is to provide a device of the type set forth above in which the pressure over the width of the tape during application is automatically maintained, uniformly over the width of the tape.

Yet another object of the invention is to provide a hand operated device of the type described above which provides a hand gripping portion which provides increased control over application of the tape to the substrate.

Still a further object of the invention is to provide a hand operated device of the type under consideration which is simple to construct and reliable in operation.

SUMMARY OF THE INVENTION

The above objects and other objects which will become apparent as the description proceeds are accomplished by providing a hand operated device for transferring a film from a carrier tape to a substrate comprising wall structure forming a housing for containing a carrier tape disposed on a reel and preferably reel means for accepting the tape after usage. The housing comprises a pair of opposed side walls and a bottom wall, and an opening formed between the side walls adjacent the forward end of the bottom wall. Applicator means extends outwardly of the housing through the opening for supporting the carrier tape and the bottom wall comprises a planar surface extending fully to the opening for contacting the substrate. Means is provided for biasing the applicator means downwardly to a point a predetermined distance below the planar surface such that a force moving the applicator means to a point whereat a tape disposed on the applicator means is in the plane of the planar surface is at least equal to the force required for depositing the film from the carrier tape onto the substrate.

The applicator means generally comprises an applicator bar which has a surface extending transversely of the bottom wall over which the carrier tape is fed.

A portion of the bottom wall planar surface may be formed on a pair of laterally disposed flanges extending outwardly from the housing side walls and the applicator bar may have a surface extending transversely of the bottom wall which has a lateral dimension substantially equal to the distance between the outer surface of the side walls adjacent the planar surface. The side walls adjacent the planar surface are generally constructed to form a hand gripping portion of the device. The applicator means is generally free to move to a position above the planar surface and the distance from the applicator means to the planar surface is in the area of 1 millimeter while the force required to move the applicator means to a point wherein a tape disposed on the applicator means is in the plane of the planar surface is in the area of 600 grams. Of course it should be well understood that other applicator means, movement ranges, and application forces may be used for different tape systems to accomplish the same mechanical result.

BRIEF DESCRIPTION OF THE DRAWING

Reference is made to the accompanying drawing in which there is shown an illustrative embodiment of the invention from which its novel features and advantages will be apparent, wherein.

DESCRIPTION OF THE PREFERRED EMBODIMENT

Figure 2:
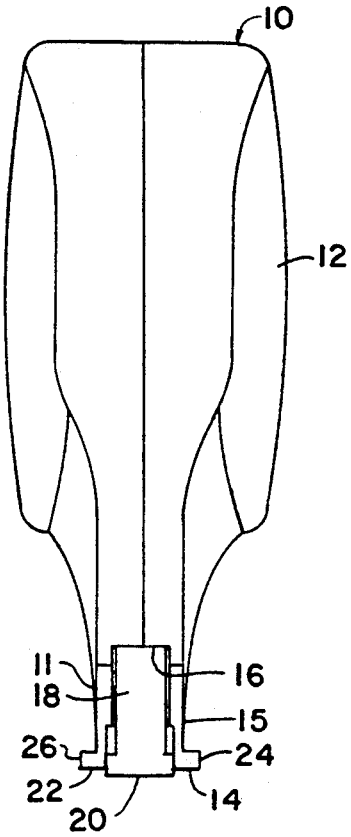
FIG. 2 is a front elevational view showing details of the structure of FIG. 1.

Referring now to the drawing, there is shown a hand operated device 10 for transferring a film from a carrier tape to a substrate. The device 10 comprises wall structure forming a housing 12 having side walls 11, 15, and a bottom wall 14 having an opening 16 formed between the side walls, at the forward end of the bottom wall.

Means for applying the tape to a substrate includes an applicator member 18 extending outwardly from the opening 16 and terminating in an applicator bar 20 transversely disposed relative to the opening 16. As best shown in FIG. 2, the width of the applicator bar 20 is substantially the distance between the outer surface of the side walls 11, 15 adjacent the bottom wall 14.

Figure 3:
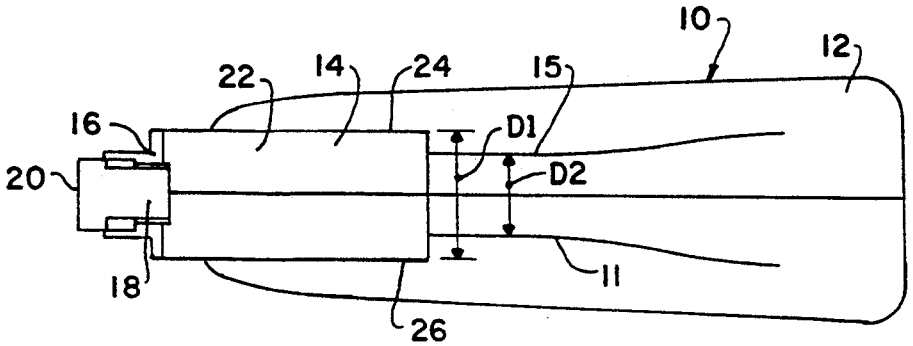
FIG. 3 is a bottom plan view showing further structural details of the hand operated device of FIGS. 1 and 2.

Referring to FIGS. 2 and 3, it will be noted that the bottom wall 14 comprises a flat planar surface 22 extending forwardly and terminating at the opening 16 through which the applicator member 18 extends. The planar surface 22 has a portion thereof disposed on a pair of laterally disposed flanges 24 and 26 which extend outwardly from the housing side walls.

Figure 1:
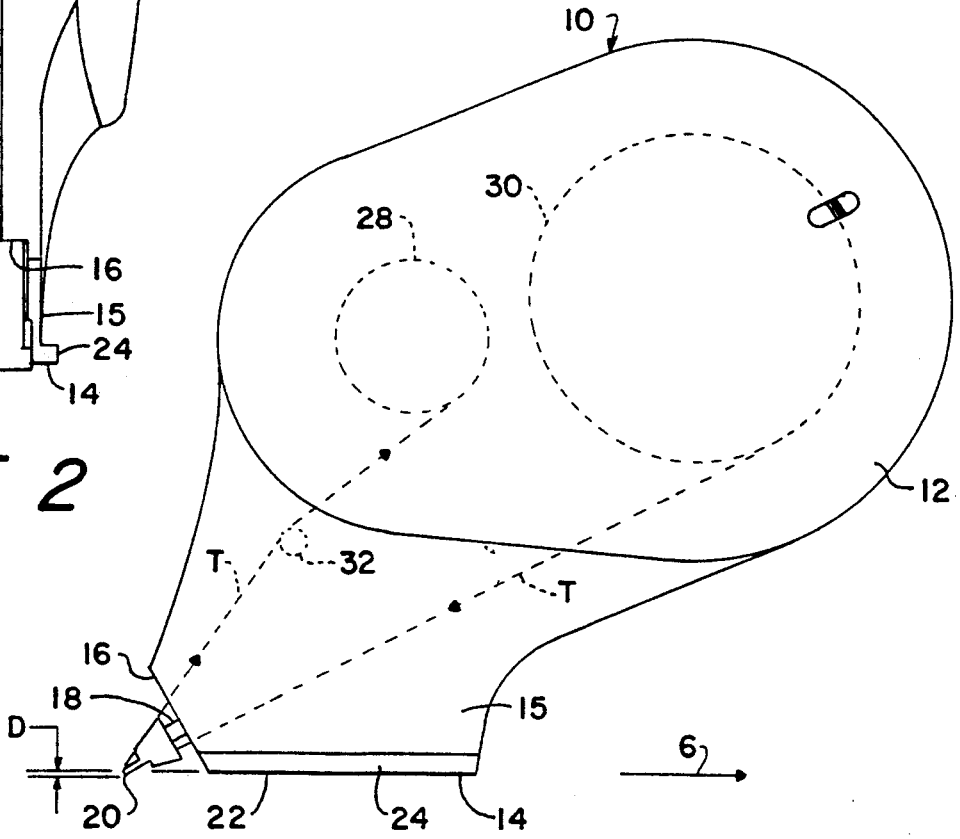
FIG. 1 is a left side elevational view showing a hand operated device for transferring a film from a carrier tape to a substrate, constructed in accordance with the teachings of the present invention.

Referring back to FIG. 1, a carrier tape T is shown in dot dash lines to designate its travel from a supply reel 30 to a reel means such as take up reel 28, the supply reel and take up reel also being shown in dot dash lines in FIG. 1. For proper feeding of the tape T a number of guide member(s) 32 may be provided in the housing 12 in order to orient the tape through the opening 16 and across the applicator bar 20 as shown in FIG. 1. The drive means to be incorporated in the housing 12 has not been shown in detail as its details are not considered necessary for an explanation of the present invention. However, the drive means may take the form of that described in previously cited U.S. Pat. No. 4,851,076 or in U.S. Pat. No. 4,853,074. For the purpose of the present invention, it will be understood that the tape T is fed from the supply reel 30 to the take up reel 28 when the device 10 is moved over the substrate in a manner described below and sufficient pressure is applied between the applicator bar and the substrate to apply the correction film contained on the under surface of the tape T to the substrate.

Referring to FIG. 1, prior to a description of the operation of the device it should be noted that the applicator member 18 is spring biased downwardly to a point a predetermined distance D below the planar surface 22. The means for spring biasing the applicator member 18 downwardly may take any form, for example a separate spring may be employed to force the applicator member downwardly or the applicator member itself may be constructed of spring material. However, the force produced by biasing the applicator member 18 downwardly must be of sufficient magnitude that when the applicator bar 20 is disposed in the plane of the planar surface 22 the force is equal to that required for depositing the film from the carrier tape onto the substrate. The applicator member 18 is not provided with a stop member in its upward travel, and is free to move above the plane of the planar surface 22 thereby ensuring that only the spring bias of the member produces a force on the substrate surface, should the substrate surface be somewhat irregular.

In operation of the device 10 the housing 12 is generally gripped by the user such that the fingers are applied at that portion of the side walls 11, 15 adjacent the flanges 24 and 26. The device is then applied to the substrate by placing the planar surface 22 onto the surface of, and in contact with the substrate, and moving the device in the direction of arrow C (FIG. 1) while maintaining at least a portion of the planar surface in contact with the surface of the substrate. With the planar surface 22 in contact with the substrate, the applicator bar 20 is moved upwardly to a point where the tape T lies in the plane of the planar surface 22 causing a force to be applied between the applicator bar 20 and the substrate which is sufficient to deposit the film from the carrier tape onto the substrate, as discussed above. In the present embodiment, it has been found that a force in the area of 600 grams is sufficient to deposit the film from the carrier tape without producing a skipping or the like in the deposited film. In the structure under consideration, the distance D lies in the area of 1 millimeter, the spring biasing force being sufficient to apply the 600 gram force when the applicator bar 20 is moved through the distance D of 1 millimeter.

In operation of the device 10 it should be recognized that the user is not required to experiment with the amount of pressure required to adequately deposit the film onto the substrate, nor is the user required to tip the device upwardly and move the applicator bar across the substrate while attempting to maintain equal pressure laterally across the applicator bar. With the device operated as previously described, the planar surface 22 prevents the user from tipping the device in the forward and aft direction while the flanges 24 and 26 extend outwardly from the gripping portion of the device 10 to produce a lateral dimension D1 of the planar surface 22 which is at least 1½ times the distance D2 between the gripped walls 11, 15 thereby preventing any sideward rocking of the device which would produce unequal lateral pressure over the applicator bar 20. The various objectives as set forth above are thereby achieved by the present invention as herein disclosed and described above.

While it is apparent that changes and modifications can be made within the spirit and scope of the present invention, it is our intention, however, only to be limited by the appended claims.

As my invention I claim:

1. A hand operated device for transferring a film from a carrier tape to a substrate comprising wall structure forming a housing for containing a carrier tape disposed on a reel, and reel means for accepting the tape after usage, said housing comprising a pair of opposed side walls and a bottom wall, and an opening formed between said side walls adjacent the forward end of said bottom wall, said bottom wall comprising a planar surface extending forwardly to said opening for contacting the substrate, applicator means extending outwardly of said housing through said opening for supporting the carrier tape, said applicator means being free to move to a position above said planar surface, and means biasing said applicator means downwardly to a point a predetermined distance below said planar surface said distance being calculated as that distance wherein a force moving said applicator means to a point whereat a tape disposed on said applicator means is in the plane of said planar surface, is at least equal to the force required for depositing the film from the carrier tape.

2. A hand operated device as set forth in claim 1 wherein said applicator means comprises an applicator bar having a surface extending transversely of said bottom wall over which the carrier tape is fed.

3. A hand operated device as set forth in claim 1 wherein a portion of said bottom wall planar surface is formed on a pair of laterally disposed flanges extending outwardly from said housing side walls.

4. A hand operated device as set forth in claim 1 wherein said applicator means comprises an applicator bar having a surface extending transversely of said bottom wall and having a lateral dimension substantially equal to the distance between the outer surface of said side walls, adjacent said planar surface, said side walls adjacent said planar surface being constructed to form a hand gripping portion of said device.

5. A hand operated device as set forth in claim 1 wherein the distance from said applicator means to said planar surface is in the area of 1 millimeter.

6. A hand operated device as set forth in claim 1 wherein the force moving said applicator means to a point wherein a tape disposed on said applicator means is in the plane of said planar surface is in the area of 600 grams.

7. A hand operated device as set forth in claim 1 wherein the distance from said applicator means to said planar surface is in the area of 1 millimeter and the force moving said applicator means to a point whereat a tape disposed on said applicator means is in the plane of said planar surface is in the area of 600 grams.

8. A hand operated device as set forth in claim 3 wherein said planar surface extends laterally a distance at least 1½ times the distance between said side walls.

9. A hand operated device as set forth in claim 2 wherein a portion of said bottom wall planar surface is formed on a pair of laterally disposed flanges extending outwardly from said housing side walls.

10. A hand operated device as set forth in claim 9 wherein said applicator bar has a lateral dimension substantially equal to the distance between the outer surface of said side walls, adjacent said planar surface, said side walls adjacent said planar surface constructed to form a hand gripping portion of said device.

11. A hand operated device as set forth in claim 10 wherein the distance from said applicator bar to said planar surface is in the area of 1 millimeter.

12. A hand operated device as set forth in claim 10 wherein the force moving said applicator bar to a point wherein a tape disposed on said applicator bar is in the plane of said planar surface is in the area of 600 grams.

13. A hand operated device as set forth in claim 10 wherein the distance from said applicator bar to said planar surface is in the area of 1 millimeter and the force moving said applicator bar to a point whereat a tape disposed on said applicator bar is in the plane of said planar surface is in the area of 600 grams.

14. A hand operated device as set forth in claim 9 wherein said planar surface extends laterally a distance at least 1½ times the distance between said side walls.

* * * * *